US006428405B1

(12) United States Patent
Tsuchiya

(10) Patent No.: US 6,428,405 B1
(45) Date of Patent: Aug. 6, 2002

(54) ABRASIVE PAD AND POLISHING METHOD

(75) Inventor: Yasuaki Tsuchiya, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/716,210

(22) Filed: Nov. 21, 2000

(30) Foreign Application Priority Data

Nov. 22, 1999 (JP) ..... 11-331535

(51) Int. Cl.[7] ..... B24D 11/00
(52) U.S. Cl. ..... 451/526; 451/529
(58) Field of Search ..... 451/526, 527, 451/529

(56) References Cited

U.S. PATENT DOCUMENTS

| | | | | | |
|---|---|---|---|---|---|
| 781,876 | A | * | 2/1905 | Gardner | 451/529 |
| 794,495 | A | * | 7/1905 | Gorton | 451/529 |
| 2,001,911 | A | * | 5/1935 | Wooddell et al. | 451/529 |
| 3,991,527 | A | * | 11/1976 | Maran | 451/529 |
| 5,910,471 | A | * | 6/1999 | Christianson et al. | 51/295 |
| 5,944,589 | A | * | 8/1999 | Nakajima | 452/285 |
| 6,019,672 | A | * | 2/2000 | Damgaard | 451/527 |
| 6,077,153 | A | * | 6/2000 | Fujita et al. | 451/259 |
| 6,217,418 | B1 | * | 4/2001 | Lukanc et al. | 451/41 |

FOREIGN PATENT DOCUMENTS

| | | |
|---|---|---|
| JP | 62-39173 | 2/1987 |
| JP | 7-321076 | 12/1995 |
| JP | 8-11051 | 1/1996 |
| JP | 10-315119 | 12/1998 |
| JP | 11-156699 | 6/1999 |

* cited by examiner

*Primary Examiner*—Joseph J. Hail, III
*Assistant Examiner*—David B. Thomas
(74) *Attorney, Agent, or Firm*—Sughrue Mion, PLLC

(57) ABSTRACT

An abrasive pad and a polishing method advantageously applicable to wafers for the production of semiconductor devices are disclosed. The abrasive pad includes a pad body capable of spinning for polishing a wafer pressed against the pad body. A number of grooves are formed in the surface of the pad body, so that slurry can flow therein. The grooves intersect each other to form a number of projections aligning in the horizontal and vertical directions and each having a polygonal shape, as seen in a plan view. One of the projections faces each groove in the lengthwise direction of the groove. This configuration enhances uniform polishing and high speed, high pressure polishing while promoting efficient use of the slurry.

7 Claims, 4 Drawing Sheets

ABRASIVE PAD AND POLISHING METHOD

BACKGROUND OF THE INVENTION

The present invention relates to an abrasive pad and a polishing method advantageously applicable to wafers for the production of semiconductor devices.

There is an increasing demand for technologies capable of flattening the surfaces of wafers with accuracy in order to implement the highly integrated, dense arrangement of semiconductor devices. A CMP (Chemical Mechanical Polishing) method, which is one of the state-of-the art flattening technologies, presses a wafer against an abrasive pad and polishes the wafer while feeding slurry or chemical polishing fluid. The CMP method, however, cannot feed slurry uniformly to the entire surface of the abrasive pad and therefore cannot uniformly polish it. Further, the slurry holding ability of the pad is too low to promote the efficient use of the slurry. Moreover, because the slurry holding ability of the pad is short, the feed of the slurry to the pad surface becomes short when the pad spins at a high speed under a high pressure. This prevents the pad from polishing the wafer at a high speed under a high pressure.

Technologies relating to the present invention are disclosed in, e.g., Japanese Patent Laid-Open Publication Nos. 62-39173,

SUMMARY OF THE INVENTION

It is therefore an object of the present invention to provide an abrasive pad and a polishing method capable of enhancing uniform polishing and high speed, high pressure polishing while promoting efficient use of the slurry.

In accordance with the present invention, in an abrasive pad including a pad body capable of spinning for polishing a workpiece pressed against the pad body, a number of grooves for slurry are formed in the surface of the pad body and intersect each other to form a number of projections aligned in the horizontal and vertical directions and each having a polygonal shape, as seen in a plan view. One of the projections faces each groove in the lengthwise direction of the groove.

Also, in accordance with the present invention, in a polishing method using an abrasive pad including a pad body that is capable of spinning for polishing a workpiece pressed against the pad body, the abrasive pad is caused to spin at a speed of 100 rpm to 150 rpm while polishing the workpiece.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1A:
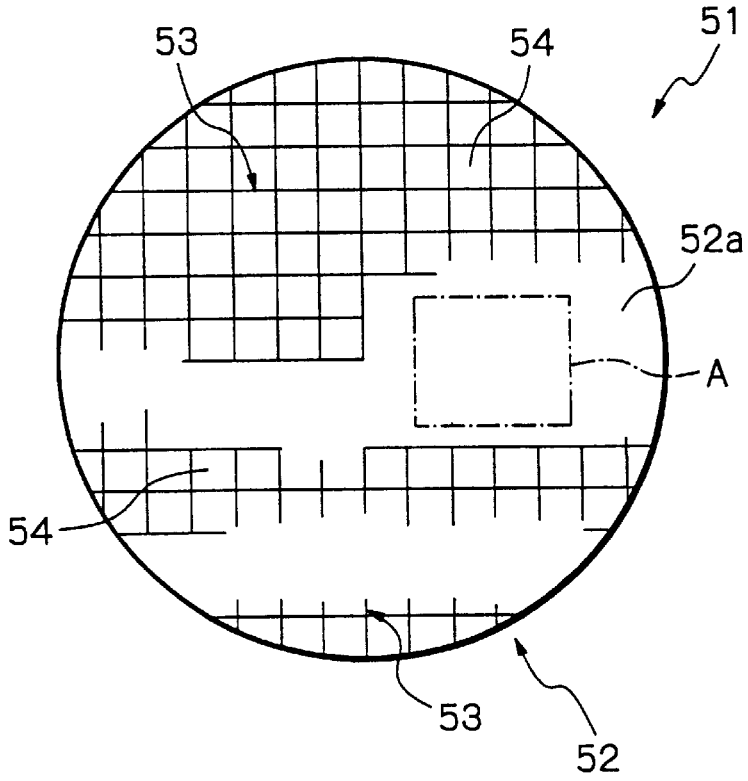
Fig. 1A PRIOR ART
FIG. 1A is a plan view showing a conventional abrasive pad.
Figure 1B:
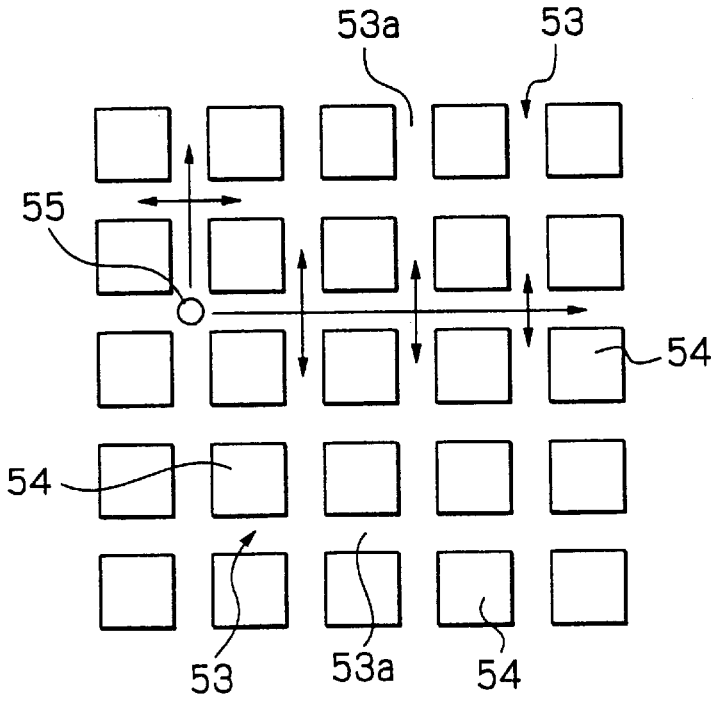
Fig. 1B PRIOR ART
FIG. 1B is a fragmentary enlarged plan view showing a portion labeled A in FIG. 1A.

To better understand the present invention, brief reference will be made to a conventional abrasive pad for the CMP method, shown in FIGS. 1A and 1B. As shown, the abrasive pad, generally 51, includes a pad body 52 having a surface 52*a*. Grooves 53 are formed in the surface 52*a* in a lattice configuration such that a number of square projections 54 protrude from the surface 52*a*. Holes (only one is shown) 55 are formed in the pad body 52 and open at the bottom 53*a* of the grooves in order to feed slurry.

To polish a semiconductor wafer or workpiece with the abrasive pad 51, the wafer is mounted to an upper lapping plate or wafer support, not shown, while the abrasive pad 51 is mounted to a lower lapping plate or platen not shown. The upper and lower lapping plates are then caused to spin in opposite directions to each other: the pad 51 spins at a speed of 50 rpm (revolutions per minute) to 80 rpm. At the same time, the two lapping plates are moved relative to each other toward the surface 52*a* of the pad body 52 with the surface of the wafer being pressed against the surface 52*a*. At this instant, the slurry in the holes 55 flows into the grooves 53 and reaches the interfaces between the surface of the wafer to be polished and the surfaces of the projections 54. After polishing the wafer, the slurry flows out of the grooves 53 in the horizontal and vertical directions of the pad 51 as a waste fluid.

A problem with the conventional abrasive pad 51 is that the slurry cannot flow uniformly in the number of linear grooves 53, which intersect each other in a lattice configuration. More specifically, each linear groove 53 has a relatively great dimension in the lengthwise direction and intersects the other grooves 53 at 90°. Consequently, the slurry in each linear groove 53 flows more slowly around the positions where it intersects the grooves 53 far from the hole 55 than around positions where it intersects the grooves 53 close to the hole 55. Such a variation in the flow speed of the slurry prevents the slurry from being uniformly fed to the entire pad surface 52*a* for uniformly polishing the wafer.

Another problem is that because the linear grooves 53 are arranged in a lattice, the slurry is easily discharged from the grooves 53 in the horizontal and vertical directions due to the spinning of the pad 51. The pad 51 therefore fails to hold a sufficient amount of slurry, resulting in the inefficient use of the slurry, as stated earlier. Further, if the slurry retaining ability of the pad 51 is insufficient, the feed of the slurry to the pad surface 52*a* becomes short when the pad 51 spins at a high speed under a high pressure. This obstructs high speed (pad speed of 100 rpm or above), high pressure polishing, as also stated earlier, Japanese Patent Laid-Open Publication Nos. 8-11051 and 11-156699 disclose abrasive cloth and a pad for polishing a flat surface, respectively. Laid-Open Publication No. 8-11051 teaches that grooves are formed in abrasive cloth from the center of the cloth toward the periphery, and that polishing portions each are positioned at the rear of a line, which connects the center of the cloth and the periphery, in the direction of rotation for polishing. Laid-Open Publication 11-156699 teaches that a plurality of narrow grooves are formed in a double-layer abrasive pad in order to divide the pad into a plurality of small regions. Neither one of these configurations can solve the problems described above.

Figure 2A:
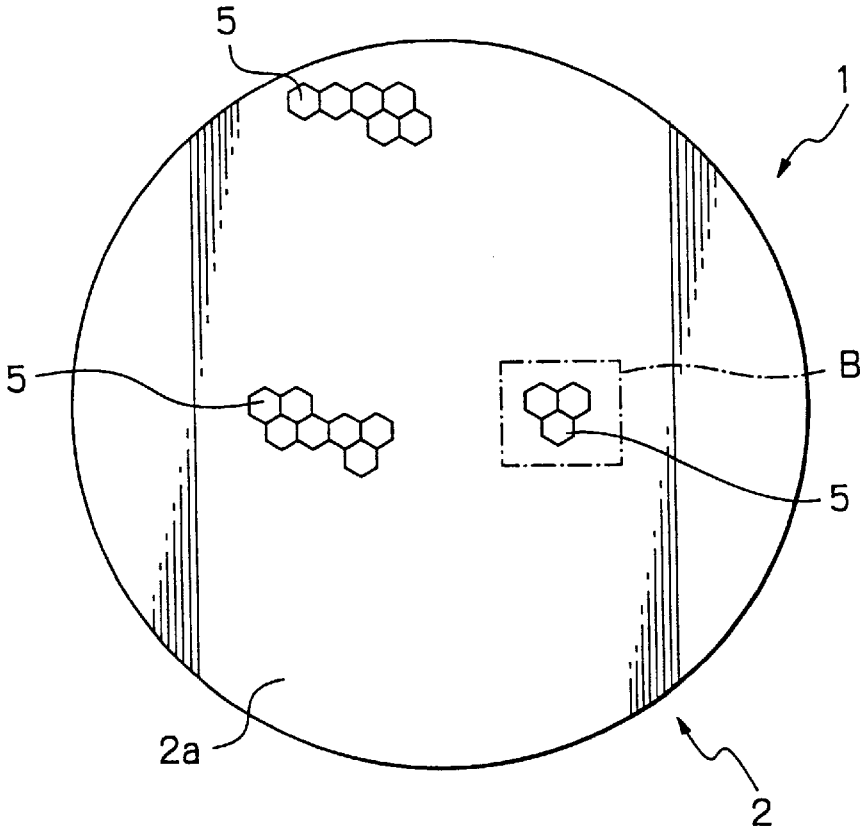
FIG. 2A is a plan view showing an abrasive pad embodying the present invention.
Figure 2B:
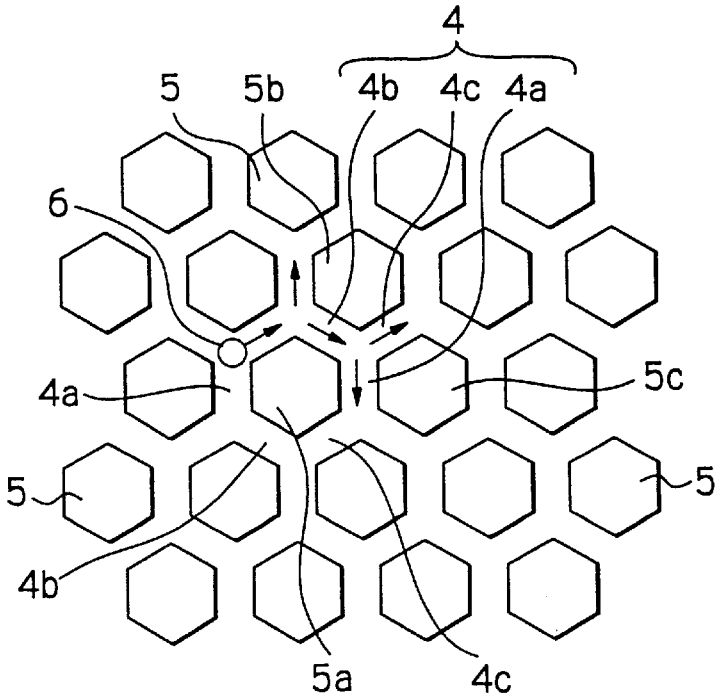
FIG. 2B is a fragmentary enlarged plan view showing a portion labeled B in FIG. 2A.
Figure 3:
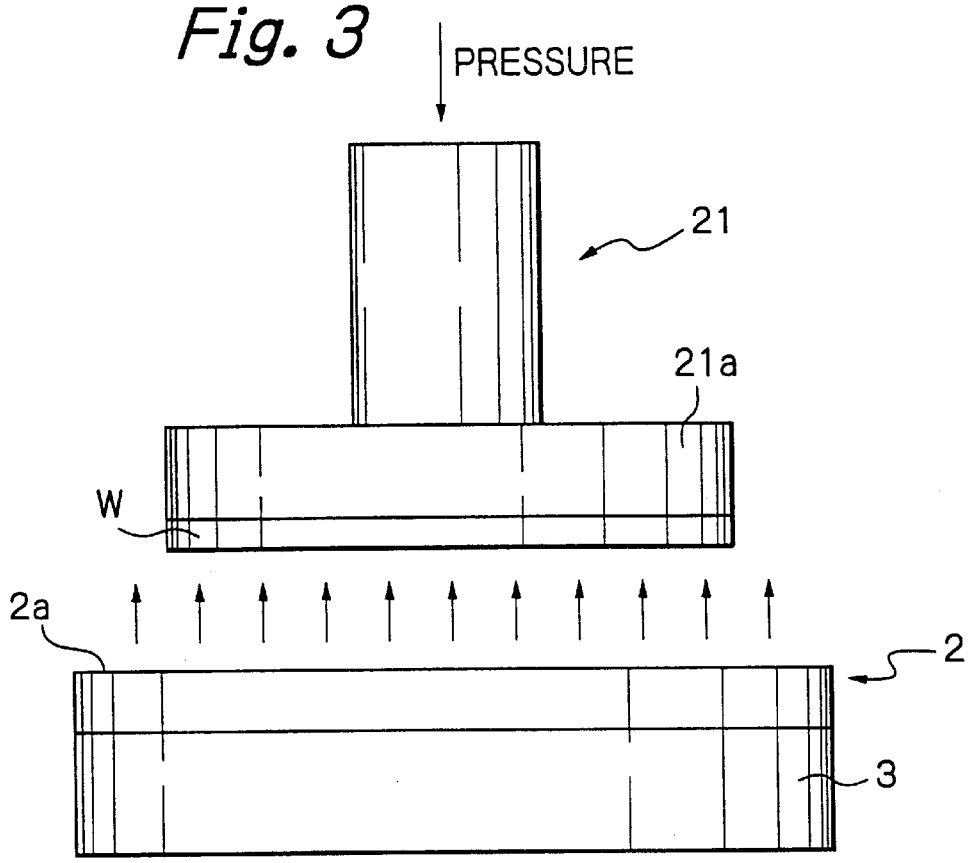
FIG. 3 is a front view showing a condition in which the abrasive pad of the illustrative embodiment is used.

Referring to FIGS. 2A, 2B and 3, an abrasive pad embodying the present invention is shown and generally designated by the reference numeral 1. As shown, the abrasive pad 1 includes a pad body 2 mounted to a platen 3. The pad 1 is a flat disk having an outside diameter of about 60 cm and formed of urethane foam.

The pad body 2 has a surface 2*a* in which a number of grooves (4*a* through 4*c*) are formed. The grooves 4 are open at the surface 2*a* and intersect each other, forming a number of hexagonal projections (5*a* through 5*c*) in a honeycomb configuration. The projections align in the horizontal and vertical directions and protrude from the pad body 2. Two grooves 4*a* and 4*b* intersect each other at an obtuse angle of 120°, as seen in a plan view. Likewise, two grooves 4*b* and 4*c* and two grooves 4*c* and 4*a* intersect each other at an obtuse angle of 120°. During polishing, slurry is fed to the surfaces of the projections 5*a* through 5*c* via the grooves 4*a* through 4*c*.

Each of the grooves 4*a* through 4*c* has a rectangular cross-section and is about 0.5 mm deep, about 1 mm wide, and about 10 mm long; the length is substantially equal to the length of one side of the hexagonal projections 5. One of the projections 5*a* through 5*c* faces each of the grooves 4*a* through 4*c* in the lengthwise direction of the groove, or two projections, e.g., projections 5*a* and 5*b* face each groove at the center portion of the pad 1. This configuration successfully reduces the linear dimension of each of the grooves 4*a* through 4*c* and thereby allows slurry to flow uniformly in the grooves 4*a* through 4*c*. Further, during polishing, the slurry does not flow from one groove, e.g., groove 4*a* to another groove, e.g., 4*b* in a moment, but remains in the grooves 4*a* through 4*c* for a moment.

Holes (only one is shown) 6 are formed in the bottom of the grooves 4*a* through 4*c* at positions where the groves 4*a* through 4*c* intersect each other. A slurry feeder, not shown, is connected to the holes 6 by tubes not shown.

As shown in FIG. 3, an upper lapping plate 21 is positioned above the platen 3 and includes a wafer support 21*a* that supports a semiconductor wafer or workpiece W.

In operation, the wafer W is mounted to the wafer support 21*a* of the upper lapping table 21 while the abrasive pad 1 is mounted to the lower lapping plate or platen 3. Subsequently, the upper lapping plate 21 is caused to spin. At the same time, the lower lapping plate 3 is caused to spin at a speed of 100 rpm to 150 rpm. The two plates 21 and 3 are moved relative to each other toward the surface 2*a* of the pad body 2 with the wafer W being pressed against the surface 2*a*. In this condition, the pad 1 polishes the wafer W.

More specifically, slurry in the holes 6 flows into the grooves 4*a* through 4*c* in a direction indicated by arrows in FIG. 2B, and reaches the interface between the surface of the wafer W and the surfaces of the projections 5*a* through 5*c*. After polishing the surface of the wafer W, the slurry flows out of the grooves 4*a* as a waste fluid.

Figure 4:
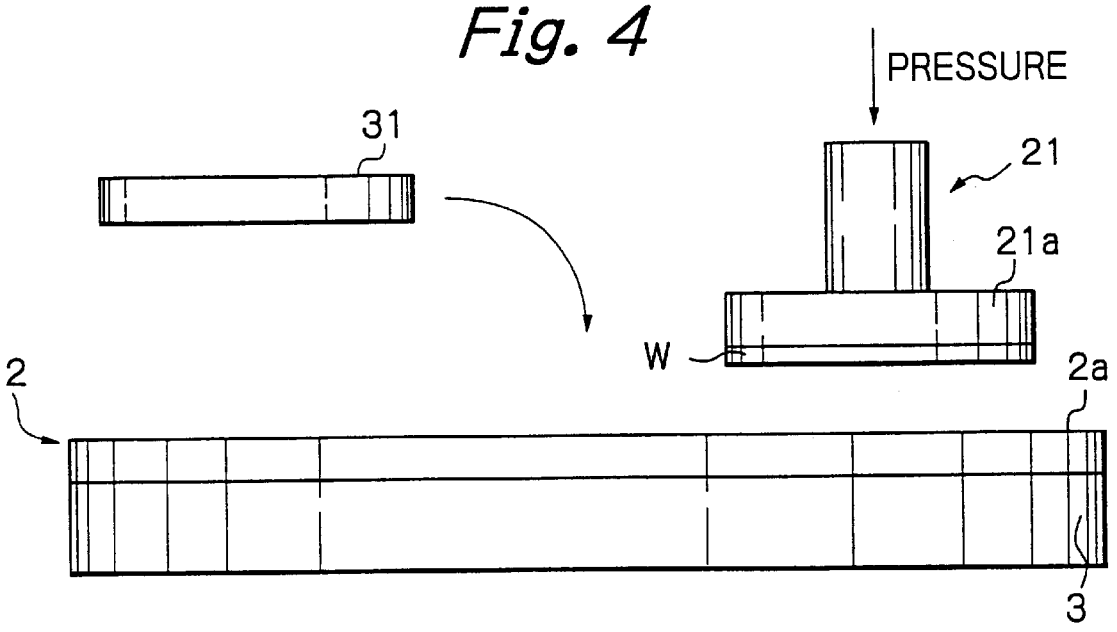
FIG. 4 is a front view showing a modification of the illustrative embodiment.

FIG. 4 shows a modification of the illustrative embodiment. As shown, slurry is fed to the pad surface 2*a* via a nozzle 31 in the form of drops. Of course, the slurry may be fed via both of the holes 6 and nozzle 31.

As stated above, in the illustrative embodiment, the projections 5*a* through 5*c* reduce the linear dimension of the grooves 4*a* through 4*c* and allow the slurry to flow uniformly in the grooves 4*a* through 4*c*. The slurry can therefore be uniformly fed to the entire surface of the pad 1. Further, the slurry does not flow from one groove, e.g., groove 4*a* to another groove, e.g., 4*b* in a moment, but remains in the grooves 4*a* through 4*c* for a moment, because of the reduced linear dimension of the grooves 4*a* through 4*c*. The pad 1 therefore achieves a sufficient slurry holding ability.

Because the pad 1 has a sufficient slurry holding ability, there can be obviated the short supply of the slurry to the pad surface 2*a*, which spins at a high speed under a high pressure. The pad 1 is capable of spinning at a speed as high as 100 rpm or above, as stated earlier. However, the spinning speed should preferably be between 100 rpm and 150 rpm because spinning speeds higher than 150 rpm degrade the slurry holding ability of the pad 1.

Figure 5:
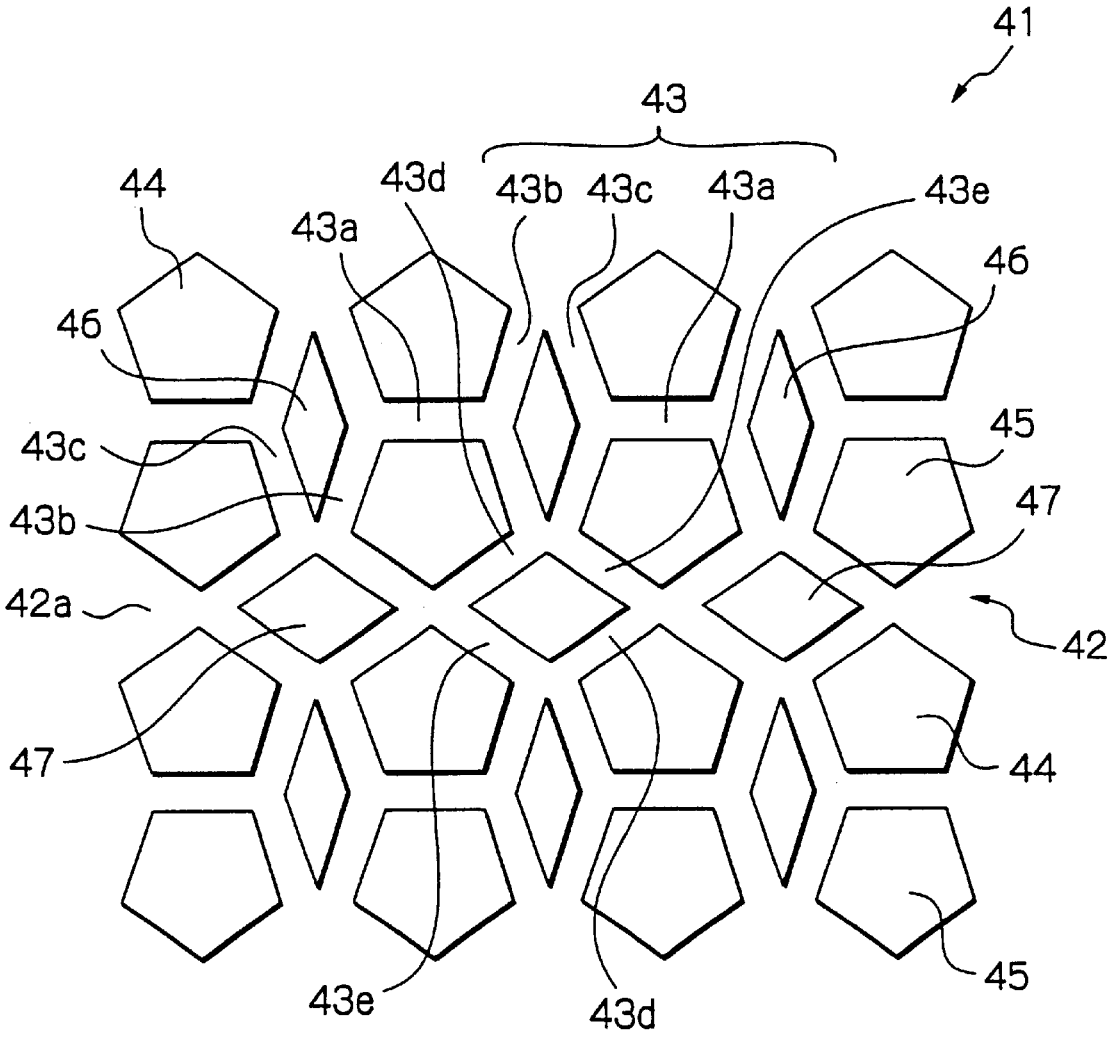
FIG. 5 is a fragmentary enlarged plan view showing an alternative embodiment of the present invention.

Reference will be made to FIG. 5 for describing an alternative embodiment of the present invention. As shown, an abrasive pad 41 includes a pad body 42 having a surface 42*a*. A number of grooves 43 (43*a* through 43*e*) are formed in the surface 42*a* and open at the surface 42*a*. The grooves 43 intersect each other in such a manner as to form four different groups of projections 44 through 47 aligned in the horizontal and vertical directions.

Each projection, or first projection, 44 and each projection, or second projection, 45 adjoining each other are symmetrical to each other with respect to one groove 43*a* intervening therebetween. The grooves 43*a* through 43*e* each intersect the other grooves at an obtuse angle or an acute angle, as illustrated. This provides the projections 44 and 45 with pentagonal shapes of the same size, as seen in a plan view.

On the other hand, each projection, or third projection, 46 and each projection, or fourth projection, 47 adjoining each other are positioned at the side of the pentagonal projections 44 and 45. The grooves 43*b* and 43*c* intersect each other at an obtuse angle while the grooves 43*d* and 43*e* intersect each other at an acute angle. The grooves 43*b* through 43*e* therefore provide the projections 46 and projections 47 with rhombic shapes of two different sizes.

Each of the grooves 43*a* through 43*e* has a rectangular cross-section and is about 1 mm deep, about 2 mm wide, and about 4 mm long. One of the projections 44 through 47 faces each of the grooves 4*a* through 4*c* in the lengthwise direction of the groove at the center portion of the pad 41. Each two grooves 43*d*, for example, merge into each other in the linear direction while two projections 44 and 45 face the grooves 43*d*. This is also true with the grooves 43*e*. This configuration successfully reduces the linear dimension of each of the grooves 43*a* through 43*e* and thereby allows slurry to flow uniformly in the grooves 43*a* through 43*e*. Further, during polishing, the slurry does not flow from one groove, e.g., groove 43*a* to another groove, e.g., 43*b* in a moment, but remains in the grooves 43*a* through 43*e* for a moment.

As stated above, in the illustrative embodiment, the projections 44 through 47 reduce the linear dimension of the grooves 43*a* through 43*e* and allow the slurry to be uniformly fed to the entire surface of the pad 41 while being held on the pad 41 in a sufficient amount, as in the previous embodiment.

There can be obviated the short supply of the slurry to the pad surface 42*a*, which spins at a high speed under a high pressure, because of the reduced linear dimension of the grooves 43*a* through 43*e*. Again, the spinning speed should preferably be between 100 rpm and 150 rpm.

While the projections of the illustrative embodiments have been shown and described as being hexagonal or pentagonal and rhombic, regular polygonal, as seen in a plan view, it may have any other suitable shape. The crux is that the linear length of each groove be smaller than a length that is three times as great as the longest side of a projection, as seen in a plan view. This is successful to feed slurry uniformly in the direction in which the projects protrude, while desirably holding it in the grooves.

In summary, it will be seen that the present invention provides an abrasive pad and a polishing method having various unprecedented advantages, as enumerated below.

(1) Slurry flows in grooves formed in the surface of the pad. One of a number of projections, which align in the horizontal and vertical directions on the surface of the pad, faces each groove in the lengthwise direction of the groove. The projections reduce the linear dimension of each groove and thereby allow the slurry to flow uniformly in the grooves during polishing. The slurry can therefore be uniformly fed to the entire surface of the pad and polish a workpiece uniformly.

(2) Because the projections reduce the linear dimension of each groove, the slurry does not flow from one groove to another groove in a moment, but remains in the grooves for a moment. The pad can therefore retain a sufficient amount of slurry thereon and be efficiently used.

(3) Because the pad has a sufficient slurry holding ability, there can be obviated the short supply of the slurry to the pad surface, which spins at a high speed under a high pressure. This implements high speed, high pressure polishing.

Various modifications will become possible for those skilled in the art after receiving the teachings of the present disclosure without departing from the scope thereof.

What is claimed is:

1. An abrasive pad comprising:

a pad body capable of spinning for polishing a workpiece pressed against said pad body;

a plurality of grooves for slurry, each having a length;

wherein said plurality of grooves are formed in a planar surface of said pad body, and intersect each other to form a plurality of projections aligned in a horizontal and a vertical direction, said projections comprising a plurality of first rows and columns of pentagonal projections, and a plurality of second rows and columns of rhombic projections aligned with and disposed between said first rows and columns of pentagonal projections as seen in plan view, so that said grooves intersect each other only at obtuse and acute angles.

2. The abrasive pad as claimed in claim 1, wherein said plurality of pentagonal projections have an identical shape and size, as seen in a plan view.

3. The abrasive pad as claimed in claim 1, wherein each of said plurality of grooves is 0.5 mm deep, 1 mm wide, and 10 mm long.

4. The abrasive pad as claimed in claim 3, wherein said grooves each have a linear length smaller than a length three times as great as a longest side of said pentagonal and rhombic projections.

5. A polishing method using an abrasive pad including a pad body that is capable of spinning for polishing a workpiece pressed against said pad body, said method comprising the steps of:

forming in a surface of said pad body a plurality of linear grooves, and forming said grooves so that they intersect each other to form a plurality of projections aligned in a horizontal and vertical direction, so that said projections comprise a plurality of first rows and columns of pentagonal projections, and a plurality of second rows and columns of rhombic projections aligned-with and disposed between said first rows and columns of pentagonal projections, and so that said grooves intersect each other only at obtuse and acute angles;

pressing the work piece against said pad body; and causing said abrasive pad to spin at a speed of 100 rpm to 150 rpm while polishing said workpiece.

6. The abrasive pad as claimed in claim 2, wherein each of said pentagonal projections has a shape of an equilateral pentagon.

7. The abrasive pad as claimed in claim 6, wherein said rhombic projections in alternate ones of said second rows have a first same size and shape, and in adjacent ones of said second rows have a second same size and shape which are different from said first same size and shape.

* * * * *

UNITED STATES PATENT AND TRADEMARK OFFICE

CERTIFICATE OF CORRECTION

PATENT NO. : 6,428,405 B1
DATED : August 6, 2002
INVENTOR(S) : Yasuaki Tsuchiya

It is certified that error appears in the above-identified patent and that said Letters Patent is hereby corrected as shown below:

Column 1,
Line 26, after "62-39173" insert -- 7-321076 and 10-315119. --

Signed and Sealed this

Twenty-first Day of January, 2003

JAMES E. ROGAN
*Director of the United States Patent and Trademark Office*